US008092127B2

(12) United States Patent
Gao et al.

(10) Patent No.: US 8,092,127 B2
(45) Date of Patent: Jan. 10, 2012

(54) RECONFIGURABLE PALLET

(75) Inventors: Dalong Gao, Troy, MI (US); Nicolas Lauzier, Ste-Favlie (CA); Robin Stevenson, Bloomfield, MI (US); Robert Jacob Scheuerman, Saginaw, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 966 days.

(21) Appl. No.: 12/051,346

(22) Filed: Mar. 19, 2008

(65) Prior Publication Data

US 2009/0235846 A1 Sep. 24, 2009

(51) Int. Cl.
*B60P 7/06* (2006.01)

(52) U.S. Cl. ..... 410/46

(58) Field of Classification Search ..... 410/46; 108/53.1, 53.3, 54.1, 55.1, 55.3, 55.5, 56.1, 108/56.3; 244/118.1
See application file for complete search history.

(56) References Cited

U.S. PATENT DOCUMENTS

| | | | | | |
|---|---|---|---|---|---|
| 2,828,931 | A * | 4/1958 | Harvey | 410/46 |
| 3,695,187 | A * | 10/1972 | Weiss | 108/54.1 |
| 3,807,581 | A * | 4/1974 | Nichols | 206/600 |
| 4,915,033 | A * | 4/1990 | Bond | 108/55.1 |
| 4,977,836 | A * | 12/1990 | Bond | 108/55.1 |
| 5,297,485 | A * | 3/1994 | Bond | 108/55.1 |
| 5,404,821 | A * | 4/1995 | Bond | 108/55.1 |
| 5,417,167 | A * | 5/1995 | Sadr | 108/57.19 |
| 5,438,740 | A * | 8/1995 | Carr et al. | 29/33 P |
| 5,497,708 | A * | 3/1996 | Jeruzal | 108/54.1 |
| 5,809,906 | A * | 9/1998 | Janek | 108/57.15 |
| 7,044,066 | B1 * | 5/2006 | Miller | 108/55.3 |
| 7,055,679 | B2 * | 6/2006 | Shen et al. | 198/867.08 |
| 7,484,464 | B2 * | 2/2009 | Shen et al. | 108/56.3 |
| 7,762,198 | B2 * | 7/2010 | Rasmusson et al. | 108/54.1 |
| 2005/0109249 | A1 * | 5/2005 | Shen et al. | 108/56.3 |
| 2009/0241808 | A1 * | 10/2009 | Lauzier et al. | 108/54.1 |
| 2009/0241810 | A1 * | 10/2009 | Lauzier et al. | 108/91 |
| 2009/0260549 | A1 * | 10/2009 | Lauzier et al. | 108/54.1 |
| 2009/0267280 | A1 * | 10/2009 | Lauzier et al. | 269/289 R |
| 2009/0277359 | A1 * | 11/2009 | Lauzier et al. | 108/55.3 |
| 2009/0277360 | A1 * | 11/2009 | Lauzier et al. | 108/55.3 |
| 2010/0200695 | A1 * | 8/2010 | Tsakiris et al. | 244/118.1 |

* cited by examiner

*Primary Examiner* — Hilary Gutman
(74) *Attorney, Agent, or Firm* — Quinn Law Group, PLLC

(57) ABSTRACT

A pallet includes a platform and a plurality of support assemblies located at multiple positions on the platform. One support assembly is associated with each location of the component to be supported. Each support assembly has several linkage assemblies to position a support element in a desired location for each version of a component. The linkage assemblies each include multiple bases secured to the platform, to position the support element in the desired location. Securing a locking mechanism on the linkage assemblies prevents movement of the support element when in the desired position. To configure the pallet for another version of the component the locking mechanisms are released, the support elements are moved to another base and the locking mechanisms are secured again for each of the support assemblies.

7 Claims, 5 Drawing Sheets

RECONFIGURABLE PALLET

TECHNICAL FIELD

The present invention relates generally to pallets for assembly plants, and more specifically to a reconfigurable pallet.

BACKGROUND OF THE INVENTION

During assembly of vehicles in an assembly plant individual components must be supported prior to installation in the vehicle. In the case of heavy or bulky components it may be necessary or desirable to support these components in a specific configuration which facilitates installation of the component into the vehicle. For example, it may be desirable to support the component in an orientation which corresponds to its in-vehicle orientation and in a manner which enables access to locations, such as boltholes, used to attach the component to the vehicle.

An example of this is a vehicle engine or powertrain (i.e. engine plus transmission), where engine and powertrain specific support structures are used for the purpose of presenting the engine or powertrain to the vehicle body in a manner which facilitates attachment of the engine or powertrain to the vehicle body.

Commonly, customers may be offered various hardware options, such as engines or powertains, with a specific vehicle body. Hence, to meet the need described above, multiple support structures must be employed each of which will be specific to a single hardware option or component version and which will be incapable of being used for other options. Frequently, for convenience and to ensure their strength and rigidity, these support structures are mounted on a platform. Together the support structure and the platform to which is attached constitute a pallet. As a result, a unique pallet is required for each version of the component associated with the assembly line.

SUMMARY OF THE INVENTION

A pallet that can be reconfigured to support multiple versions of a component associated with an assembly line is desired.

A pallet of the present invention includes a platform and a plurality of support assemblies located at multiple positions on the platform. One support assembly is associated with each support location of the component. The support assemblies each include a support element and a plurality of bases, one base for each version of the component to be supported.

The support element is positioned in the desired base. An interface on the base for receiving a footing of the support element places the support element in the desired location. The support element includes a locator. Once positioned in the base, the locator corresponds to a predetermined location on the component which has a mount for alignment. The height of the interface places the locator at the appropriate height for the mount of that version of the component.

The support element is constrained by several linkage assemblies. Each linkage assembly has a foundation secured to the platform. A first arm is rotatably connected to the foundation with a locking joint and a second arm is rotatably connected to the first arm with a free joint. A locking mechanism is associated with the locking joint to selectively prevent rotation of the first arm about a first axis. Securing the locking mechanism prevents movement of the first arm relative to the foundation. An aperture for receiving the support element is defined by the second arm.

Once the footing for the support element is received by the interface of the base and the locking mechanism for each linkage assembly is secured, the location of the support element is fixed. However, the support element is still free to slideably move within the aperture. Gravity and weight of the component restrict the support element from moving during pallet usage.

To configure the support assembly for another version of the component the locking mechanisms are both released. The footing is moved from the interface of the current base to the interface of another. The locking mechanisms are again secured to fix the support element in position.

The linkage assemblies allow the pallet to quickly and easily be reconfigured by a single operator. Configuring a single pallet to be used with multiple versions of a component on an assembly line reduces costs.

The above features and advantages, and other features and advantages of the present invention will be readily apparent from the following detailed description of the preferred embodiments and best modes for carrying out the present invention when taken in connection with the accompanying drawings.

DESCRIPTION OF THE PREFERRED EMBODIMENTS

Figure 1:
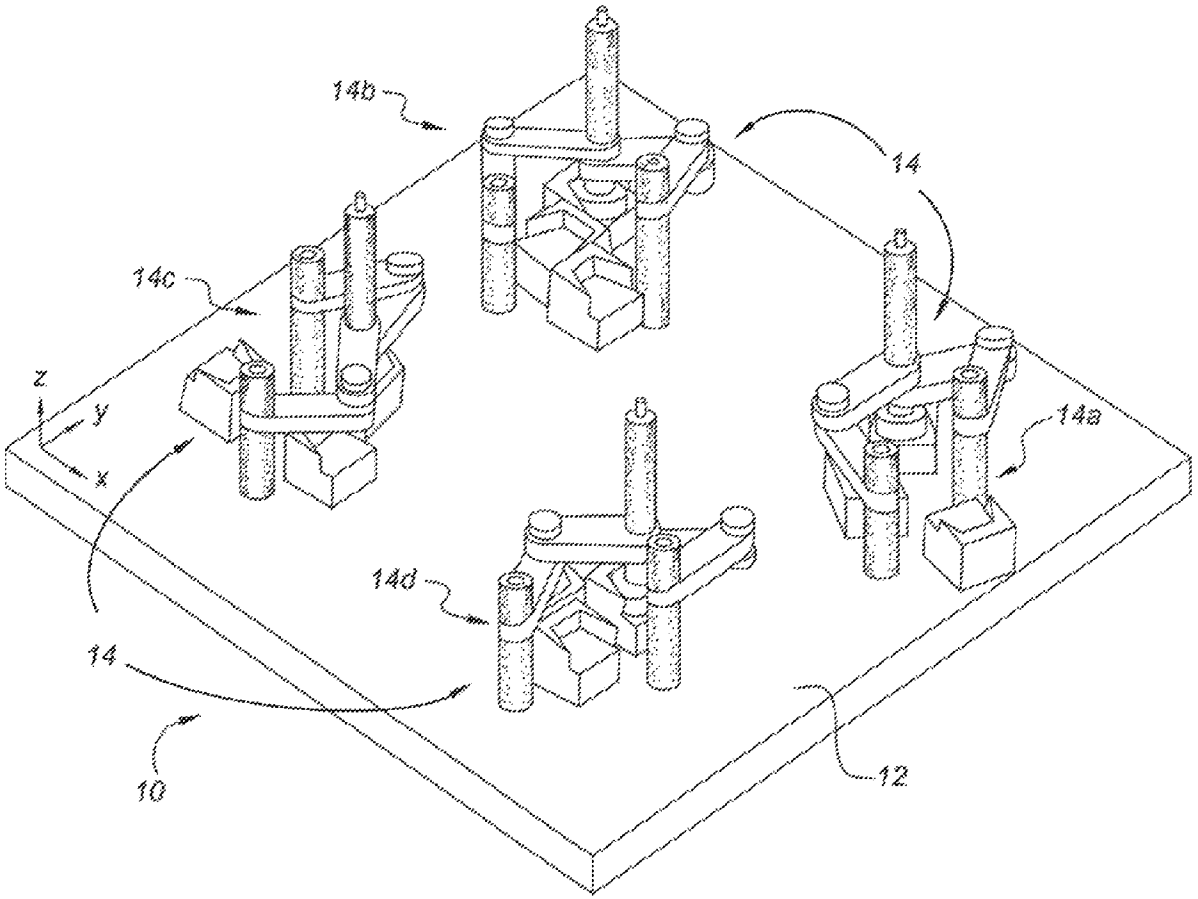
FIG. 1 is a perspective view illustrating a reconfigurable pallet of the present invention.

Referring to the Figures, wherein like reference numbers refer to the same or similar components throughout the several views, FIG. 1 is a perspective view of an exemplary pallet 10 of the present invention.

The pallet 10 includes a platform 12 and a plurality of support assemblies 14 located at multiple positions on the platform 12. As shown, four support assemblies 14*a-d* are located one at each corner 16 of the platform 12. One support assembly 14 is associated with each support location for the component. The number and location of the support assemblies 14 is determined by the design and type of the component to be supported. An x, y and z direction are defined by the pallet 10. Each support assembly 14*a-d* is located at a specific x-y-z coordinate as described below.

Figure 2:
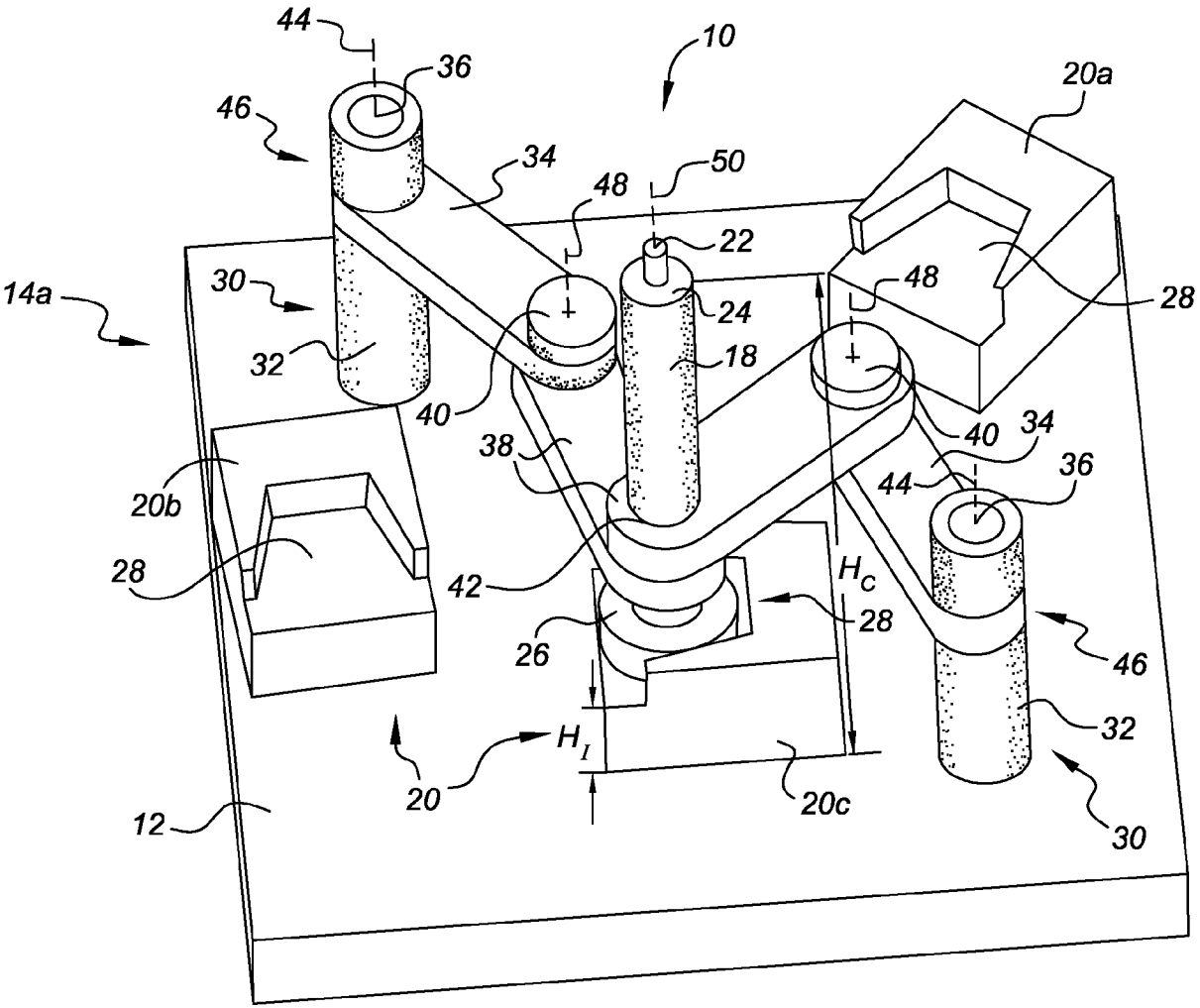
FIG. 2 is an enlarged perspective view of one support assembly for the pallet of the present invention.

FIG. 2 illustrates an enlarged perspective view of one section of the pallet 10 showing one of the support assemblies 14*a*. The other support assemblies 14*b-d* on the pallet 10 are configured in the same manner as described herein. The support assembly 14*a* includes a support element 18 and a plurality of bases 20. Preferably, there are multiple bases 20, one base for each version of the component to be supported. In the embodiment of FIG. 2, there are three bases 20: a first base 20*a*, a second base 20*b*, and a third base 20*c*. Therefore, the example embodiment is a pallet 10 for use with a component having three different configurations. For example, the component is an engine and three different engines are available for a vehicle assembled on the assembly line. The pallet 10 can be configured to support each version of the engine. Additional versions of the components can be accommodated by adding another base 20 at the appropriate location for each support assembly 14.

The support element 18 includes a locator 22 along an end 24, as shown. The locator 22 corresponds to a predetermined location on the component which has a mount for alignment with the locator 22. The locator 22 is positioned at a specific location and height to correspond to the component mount. In the embodiment shown, the locator 22 is a pin that could correspond to a female receptacle defined by the component at the mount. For example, the component is an engine and a pin receiver is positioned on the engine at the component mount location. Alternately, the locator 22 may be a support plane that corresponds to a plane on the component at the mount. Other arrangements may be used for the locator 22, such as, a female receptacle defined by the locator 22 and a male coupling on the component at the mount.

The support element 18 is positioned in the desired base 20, in this instance base 20*c*. The support element 18 has a footing 26. The footing 26 is received by the desired base 20*c*. In the embodiment shown, the multiple bases 20*a-c* each have an interface 28 for receiving the footing 26. The interface 28 places the support element 18 in the desired x-y coordinate location. The interface height $H_I$ of the desired base 20*c* places the locator pin 22 at the appropriate component height $H_C$ for that version of the component. Therefore, each base 20*a-c* is associated with a specific x-y-z coordinate appropriate to the version of the component being supported on the pallet 10 by the base 20*a-c*.

The support element 18 is constrained by several linkage assemblies 30. The linkage assemblies 30 guide and support the support element 18 and ensure that there are no loose parts associated with the pallet 10 to prevent dropping of parts during pallet reconfiguration. Each linkage assembly 30 has a foundation 32 secured to the platform 12. A first arm 34 is rotatably connected to the foundation 32 with a locking joint 36. A second arm 38 is rotatably connected to the first arm 34 with a free joint 40. An aperture 42 for receiving the support element 18 is defined by the second arm 38 and is positioned remotely from the free joint 40. The support element 18 can freely rotate and slide in the z-direction when located within the aperture 42.

The locking joint 36 rotatably connects the first arm 34 to the foundation 32. The first arm 34 rotates about a first axis 44 that is oriented in the z-direction. A locking mechanism 46 is associated with the locking joint 36 to prevent rotation of the first arm 34 about the first axis 44. Securing the locking mechanism 46 prevents movement of the first arm 34 relative to the foundation 32 and thus, to the platform 12.

The free joint 40 rotatably connects the second arm 38 with the first arm 34. The second arm 38 rotates about a second axis 48 that is also oriented in the z-direction, and is parallel to the first axis 44. The x-y coordinate location of the second axis 48 may be changed by rotating the first arm 34 about the first axis 44, when the locking mechanism 46 is not secured. Once the locking mechanism 46 is secured, the x-y coordinate location of the second axis 48 is fixed.

The support element 18 rotates within the aperture 42 about a third axis 50 that is oriented in the z-direction and parallel to the first and second axes 44 and 48. The x-y coordinate location of the third axis 50 may be changed by rotating the second arm 38 about the second axis 48. Both linkage assemblies 30 are arranged in the manner described, as depicted in FIG. 2. Once the footing 26 is received by the interface 28 and the locking mechanism 46 for each linkage assembly 30 is secured, the x-y coordinate location of the third axis 50 is fixed. The support element 18 is still free to rotate within the aperture 42 about the third axis 50 and is slideably moveable vertically, along the third axis 50. Gravity and the weight of the component restrict the support element 18 from moving along the third axis 50 during pallet 10 usage. When the support element 18 is located within the aperture 42 for each linkage assembly 30 the third axis 50 for both linkage assemblies 30 is in the same x-y coordinate location, as shown.

To configure the support assembly 14*a* for another version of the component the locking mechanisms 46 are both released. The footing 26 is moved from the interface 28 of base 20*c* to the interface 28 of base 20*a* or 20*b*, as desired, and the support element 18 is moved within aperture 42 for vertical adjustment. The locking mechanisms 46 are again secured to fix the support element 18 in position.

To reconfigure the entire pallet 10 this is repeated for each of the support assemblies 14*a-d* located on the pallet 10. To ensure proper positioning of the support element 18 for each of the support assemblies 14*a-d* the bases 20 may be colored or numbered alike for each version of the component. That is, base 20*a* of support assembly 14*a* has a matching color to a similar base 20*a* of each of the support assemblies 14*b-d* on the pallet 10. Base 20*b* of support assembly 14*a* would have another color matching each similar base 20*b* of each of the support assemblies 14*b-d* and base 20*c* of support assembly 14*a* would have a third color matching each similar base 20*c* of each of the support assemblies 14*b-d*. Positioning the footings 26 for each support assembly 14*a-d* with similarly colored bases 20 to one another would ensure that the locators 22 are in the proper location for each version of the component. For example, the component is an engine and each version of the engine would have a color associated therewith. All of the bases 20 utilized to support that engine version would be the associated color.

Additionally, the bases 20*a-c* for each support assembly 14*a-d* may have different interface heights $H_I$ than one another. That is, the interface height $H_I$ for the base 20*a* of the support assembly 14*a* may differ from the interface height of the base 20*a* of the support assembly 14*b* which differs from the interface height of the base 20*a* of the support assemblies 14*c* and 14*d*. The interface height $H_I$ for the bases 20*a-c* is determined by the component mount requirement at each support assembly 14*a-d* location for that version of the component.

Figure 3:
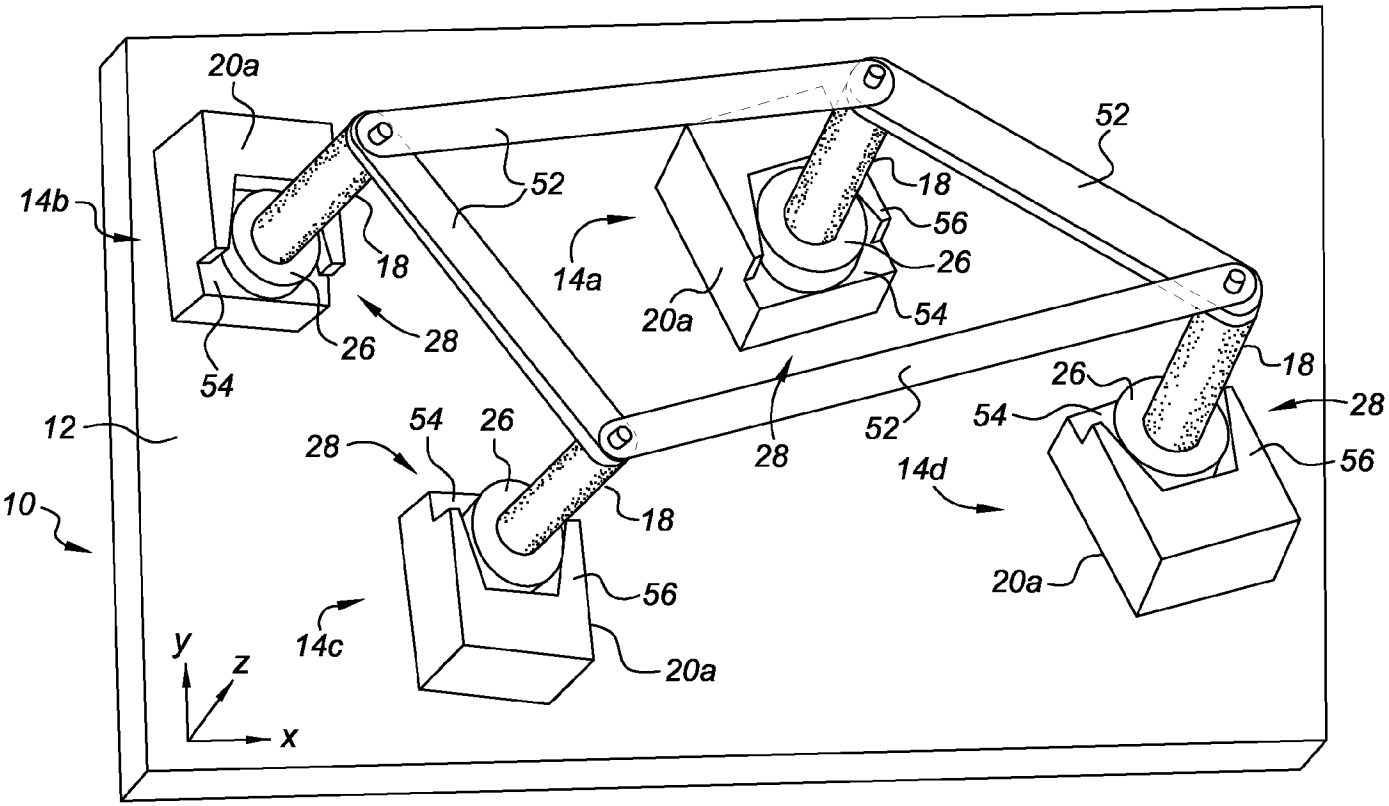
FIG. 3 is a perspective view illustrating the reconfigurable pallet of the present invention supporting a component.

FIG. 3 illustrates support of one version of a component on the pallet 10. The support elements 18 and bases 20*a* for the one version of the component are shown. The remaining portions of the support assemblies 14*a-d* are removed for simplicity. The component to be supported is represented by rigid links 52. As shown, each base 20*a* is oriented in a different manner. Thus, an opening 54 of the interface 28 faces a different direction from the openings 54 of the other bases 20*a*. Walls 56 of the interface 28 assist in preventing movement of the support element 18 and the footing 26. The walls 56 also absorb lateral forces, in the x or y direction, caused by the component during movement of the pallet 10.

Figure 4:
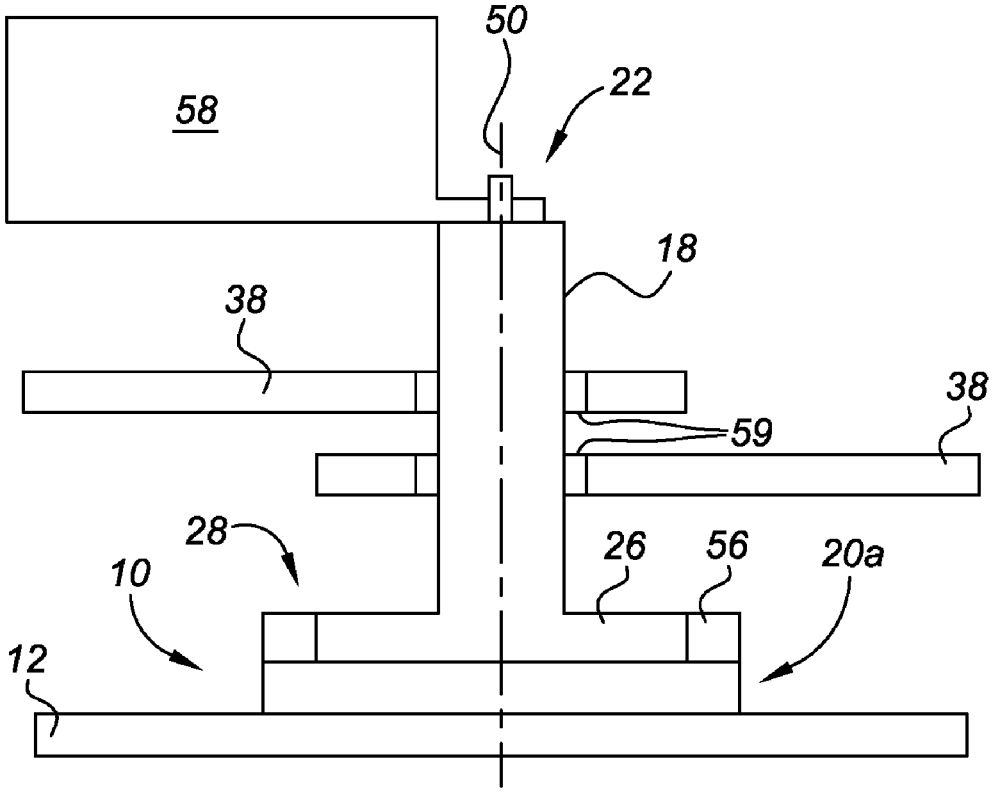
FIG. 4 is a side view of one support element located in a base of a support assembly for the pallet of the present invention.

FIG. 4 is a side view of one support element 18 located in a base 20*a*. The component is represented by an element 58 mounted on the locator 22. The footing 26 of the support element 18 is received by the interface 28. Walls 56 assist in absorbing lateral forces acting on the support element 18 by element 58. The second arm 38 of both linkage assemblies 30 support the support element 18. Bushings 59 may be located between the support element 18 and the second arms 38. The bushings 59 provide support to and allow rotational and vertical movement of the support element 18.

Figure 5:
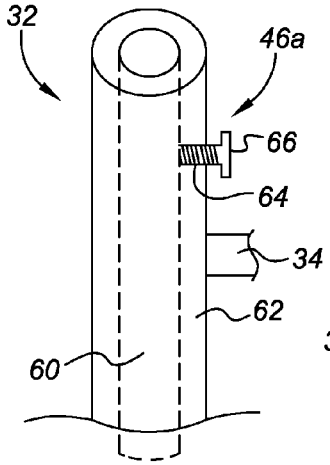
FIG. 5 is a schematic view of an embodiment of a locking mechanism of the support assemblies for the pallet of the present invention.
Figure 6:
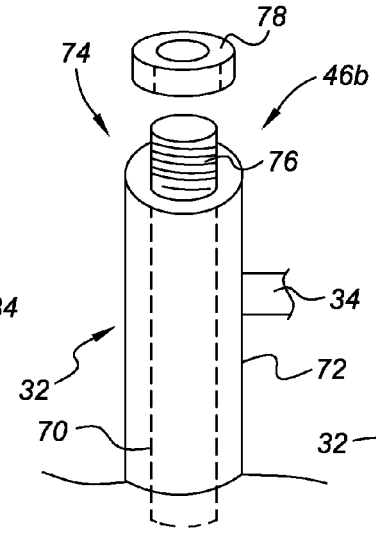
FIG. 6 is a schematic view of another embodiment of a locking mechanism of the support assemblies for the pallet of the present invention.
Figure 7:
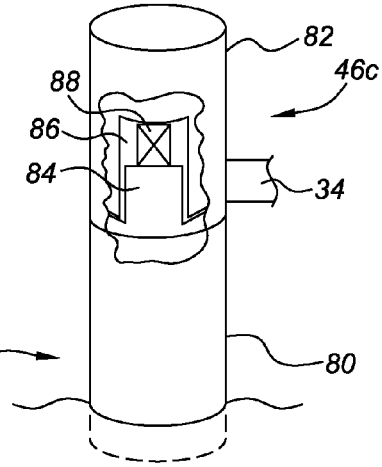
FIG. 7 is a schematic view of another embodiment of a locking mechanism of the support assemblies for the pallet of the present invention.

FIGS. 5-7 illustrate several embodiments of the locking mechanism 46. FIG. 5 shows the locking mechanism 46*a* having a foundation 32 which includes a platform portion 60 and an arm portion 62. The first arm 34 extends from the arm portion 62. The platform portion 60 is secured to the pallet 10 in a known manner. For example, the embodiment shown has a press fit between the platform portion 60 and the platform 12. The arm portion 62 is mounted to rotate about the platform portion 60. The arm portion 62 includes an opening 64 for receiving a screw 66, or the like. When the arm portion 62 is in the desired rotational position the screw 66 is threaded within the opening 64 and tightened to apply friction to the platform portion 60, preventing rotation between the platform portion 60 and the arm portion 62. The screw 66 is then loosened to reduce the friction and allow rotation of the arm portion 62 as necessary. Alternately, a pin or other element may be used to apply friction to the platform portion through the opening 64.

FIG. 6 shows the locking mechanism 46*b* having a foundation 32 which includes a platform portion 70 and an arm portion 72. The first arm 34 extends from the arm portion 72. The platform portion 70 is secured to the pallet 10, in a known manner. The arm portion 72 is mounted to rotate about the platform portion 70. A mounting location 74 of the platform portion 70 extends beyond the arm portion 72 to provide a surface 76 for receiving a nut 78. When the arm portion 72 is in the desired rotational position the nut 78 is threaded on surface 76 and is tightened to apply friction to the arm portion 72 preventing rotation between the platform portion 70 and the arm portion 72. The nut 78 is loosened to allow rotation of the arm portion 72 as necessary. Alternately, the nut 78 may include a handle to provide easier tightening and loosening by an operator. The nut 78 may also be replaced with other devices which can apply friction to the arm portion 72.

FIG. 7 shows the locking mechanism 46*c* having a foundation 32 which includes a platform portion 80 and an arm portion 82. The first arm 34 extends from the arm portion 82. The platform portion 80 is secured to the pallet 10, in a known manner. The arm portion 82 is mounted to rotate about the platform portion 80. A mounting location 84 of the platform portion 80 extends into a cavity 86 defined within the arm portion 82. A tension spring 88, or the like, is located between the arm portion 82 and the mounting location 84. The tension spring 88 causes friction between the arm portion 82 and the platform portion 80 preventing rotation between the platform portion 80 and the arm portion 82. To move the arm portion 82 to the desired rotational position an operator moves the arm portion 82 in the z-direction to remove or reduce the friction between the arm portion 82 and the platform portion 80. The operator rotates the arm portion 82 to the desired rotational position and then releases the arm portion 82. The arm portion 82 returns to the original z-axis position and the tension spring 88 again applies friction between the platform portion 80 and the arm portion 82 to prevent rotation thereof.

Although several embodiments of locking mechanisms 46 are disclosed, other locking mechanisms 46 which would selectively prevent relative rotational movement between the foundation 32 and the first arm 34 may be utilized. Devices such as those utilizing friction elements, screws/pins, spring loads, etc., are known in the art for preventing relative movement between two elements and would be applicable as locking mechanisms 46.

In the above embodiments an example of the component to be supported is an engine. This is in no way meant to be restrictive and other components may be utilized with the reconfigurable pallet of the present invention.

While the best modes for carrying out the invention have been described in detail, those familiar with the art to which this invention relates will recognize various alternative designs and embodiments for practicing the invention within the scope of the appended claims.

The invention claimed is:

1. A pallet to support a component for assembly operations comprising:

a plurality of support assemblies each mounted to a platform;

wherein each of the plurality of support assemblies includes:

a plurality of reconfigurable and lockable linkage assemblies mounted to the platform;

a support element moveably mounted to the plurality of linkage assemblies and configured to be selectively located in one of a plurality of positions;

a plurality of bases configured to selectively receive the support element; and a locking mechanism associated with each of the plurality of linkage assemblies and configured to selectively fix the one of the plurality of positions of the support element relative to the platform; and wherein movement and locking of the support element in one of the plurality of positions is enabled via the plurality of linkage assemblies.

2. The pallet of claim 1, wherein the support element is configured to adjust in a plurality of directions parallel to the platform via movement of the plurality of linkage assemblies and configured to adjust in a direction perpendicular to the platform via the plurality of bases and sliding of the support element relative to the plurality of linkage assemblies.

3. The pallet of claim 2, wherein the plurality of bases each comprise an interface to receive a footing of the support element, and wherein the interface has a predetermined height corresponding to a desired height for a locator on the support element at an opposing end from the footing.

4. The pallet of claim 3, wherein the interface of one of the plurality of bases is oriented to face a different direction from the interfaces of all other of the plurality of bases.

5. The pallet of claim 1, wherein each of the plurality of linkage assemblies further comprises a foundation secured to the platform, a first arm rotatably connected to the foundation and a second arm rotatably connected to the first arm, wherein the support element is slideably and rotatably mounted to the second arm.

6. The pallet of claim 5, wherein the first arm is rotatably connected to the foundation with a locking joint to secure the first arm from rotational movement relative to the foundation, and wherein the support element is fixed in the one of the plurality of positions when the locking mechanism is in a locked position.

7. The pallet of claim 5, wherein the first arm, the second arm and the support element are configured to rotate about axes parallel to one another and perpendicular to the platform.

* * * * *